US009451797B1

(12) United States Patent
Ashkanani

(10) Patent No.: US 9,451,797 B1
(45) Date of Patent: Sep. 27, 2016

(54) HYGIENIC SPORTS GLOVE

(71) Applicant: Reham Ashkanani, Kuwait (KW)

(72) Inventor: Reham Ashkanani, Kuwait (KW)

( * ) Notice: Subject to any disclaimer, the term of this patent is extended or adjusted under 35 U.S.C. 154(b) by 0 days.

(21) Appl. No.: 15/188,901

(22) Filed: Jun. 21, 2016

(51) Int. Cl.

| | |
|---|---|
| ***A41D 19/00*** | (2006.01) |
| ***A61M 35/00*** | (2006.01) |
| ***A47K 10/02*** | (2006.01) |
| ***A45D 34/02*** | (2006.01) |
| ***A47K 10/16*** | (2006.01) |
| ***A63B 71/14*** | (2006.01) |
| *A45D 34/00* | (2006.01) |

(52) U.S. Cl.
CPC ..... *A41D 19/0024* (2013.01); *A41D 19/002* (2013.01); *A41D 19/0048* (2013.01); *A45D 34/02* (2013.01); *A47K 10/02* (2013.01); *A47K 10/16* (2013.01); *A63B 71/141* (2013.01)

(58) Field of Classification Search
CPC .. A45D 34/00; A45D 40/00; A41D 19/0024; A41D 19/0037; A41D 19/002; A41D 19/01594; A41D 19/0055; A44C 15/002; A44C 5/0007; A44C 5/0023; A61L 9/12; A61L 2/0088; A47K 5/1201
See application file for complete search history.

(56) References Cited

U.S. PATENT DOCUMENTS

| | | | | |
|---|---|---|---|---|
| 2,235,350 A * | 3/1941 | Anderson | A44C 15/002 | 206/37 |
| 4,042,975 A * | 8/1977 | Elliott, Jr. | A63B 71/143 | 2/161.1 |
| 4,087,675 A * | 5/1978 | Sansonetti | H05B 3/342 | 2/158 |
| 4,244,057 A * | 1/1981 | Burnham | A41D 19/0024 | 2/160 |
| 4,326,706 A * | 4/1982 | Guthrie | A63B 21/065 | 2/160 |

(Continued)

FOREIGN PATENT DOCUMENTS

| | | |
|---|---|---|
| JP | 3-264003 | 11/1991 |
| WO | WO 93/08709 A1 | 5/1993 |

OTHER PUBLICATIONS

"Sq-easy Washing up gloves" http://www.sgeasygloves.com (Last Accessed on Nov. 24, 2015) 2 pgs.

*Primary Examiner* — Bobby Muromoto, Jr.
(74) *Attorney, Agent, or Firm* — Richard C. Litman

(57) ABSTRACT

The hygienic sports glove includes a palm surface, an opposing back surface, and a strap configured for securing the glove onto a person's wrist. The glove further includes a first built-in pocket positioned on the back surface of the glove for storing a towel and/or tissues therein. A second built-in pocket is positioned adjacent the first built-in pocket of the glove. A perfume container, such as a spray-type perfume container, is positioned within the second built-in pocket. The container has a spray tube positioned in fluid communication with the first built-in pocket and a refill tube configured for receiving perfume from another container.

8 Claims, 6 Drawing Sheets

(56) References Cited

U.S. PATENT DOCUMENTS 4,736,876 A * 4/1988 Kriss ..... A45C 1/04 222/175
4,766,611 A * 8/1988 Kim ..... A41D 19/0027 2/160
4,805,242 A * 2/1989 Bolton ..... A41D 19/0024 2/160
4,843,652 A * 7/1989 Kuwahara ..... A41D 20/00 2/158
4,850,052 A * 7/1989 Matthews ..... A41D 19/0024 2/160
D320,872 S 10/1991 McCrane
5,088,624 A * 2/1992 Hackett ..... F41H 9/10 222/132
5,683,012 A * 11/1997 Villaveces ..... A45F 5/02 222/175
5,706,521 A * 1/1998 Haney ..... A41D 19/0037 2/160
5,867,829 A * 2/1999 Hegoas ..... A01K 13/003 119/605
5,924,136 A * 7/1999 Ogean ..... A45C 1/04 2/159
6,126,041 A * 10/2000 DiTomasso ..... A45F 3/20 222/175
6,126,085 A * 10/2000 Wanzenbock ..... A61L 9/12 239/36
6,141,801 A * 11/2000 Helenick ..... A41D 19/01535 2/159
6,371,946 B1 * 4/2002 Ostrow ..... A61M 35/00 222/175
6,513,439 B2 * 2/2003 Brown ..... F42B 12/40 102/513
7,135,011 B2 * 11/2006 Powers ..... A45D 34/00 604/310
7,285,114 B2 * 10/2007 Harper ..... A61B 90/80 206/531
7,316,332 B2 * 1/2008 Powers ..... A45D 34/00 222/1
7,451,496 B2 * 11/2008 Carey ..... A41D 19/01529 2/160
8,286,834 B2 * 10/2012 Powers ..... A45D 34/00 222/175
8,517,171 B1 * 8/2013 Delgado ..... B65D 83/0805 206/229
8,950,632 B2 * 2/2015 Ciavarella ..... A44C 5/0023 222/175
2002/0170927 A1 * 11/2002 Gerstner ..... F41H 9/10 222/175
2004/0031120 A1 * 2/2004 Cherian ..... A41D 19/0024 15/227
2004/0172736 A1 * 9/2004 Reid ..... A45C 1/04 2/169
2004/0206832 A1 * 10/2004 Yeung ..... A44C 5/0007 239/44
2004/0244090 A1 * 12/2004 Langer ..... A41D 19/002 2/160
2005/0125877 A1 * 6/2005 Benjamin ..... A41D 19/01 2/158
2005/0125924 A1 * 6/2005 Benjamin ..... A47K 7/03 15/104.94
2005/0199741 A1 * 9/2005 Thomson ..... A41D 13/1245 239/36
2006/0078484 A1 * 4/2006 Greep ..... A61L 2/0011 422/300
2006/0169794 A1 * 8/2006 Yeung ..... A44C 5/0007 239/44
2006/0169795 A1 * 8/2006 Yeung ..... A44C 5/0007 239/44
2006/0192031 A1 * 8/2006 Yeung ..... A44C 5/0007 239/327
2008/0229476 A1 * 9/2008 Sanders ..... A41D 19/01535 2/159
2012/0282011 A1 * 11/2012 Francois ..... A61L 2/18 401/196
2014/0342964 A1 * 11/2014 Jackson ..... C11D 3/50 510/106

* cited by examiner

HYGIENIC SPORTS GLOVE

BACKGROUND OF THE INVENTION

1. Field of the Invention

The present invention relates generally to sports gloves, and particularly to a hygienic sports glove for removing sweat from a person engaged in athletic exercises.

2. Description of the Related Art

During exercise, people tend to sweat on the exercise equipment they may be using. As such, gyms can become a breeding ground for a variety of germs. While many people use personal towels to wipe off sweat from their bodies, they tend to hang their towels on the exercise equipment while they are exercising. As such, these towels become just another way to transmit or transfer germs from one machine to another or from one person to another.

Thus, a hygienic sports glove solving the aforementioned problems is desired.

SUMMARY OF THE INVENTION

The hygienic sports glove includes finger portions, a wrist portion, a palm surface and an opposing back surface. The wrist portion includes a strap configured for securing the glove onto a person's hand. The glove further includes a first built-in pocket positioned on the back surface of the glove. The first built-in pocket has a top portion and a bottom portion. Each portion has a corresponding flap. A second built-in pocket is positioned adjacent to the first built-in pocket of the glove. A perfume container, such as a spray-type perfume container is positioned within the second built-in pocket. The container has a spray tube positioned in fluid communication with the first built-in pocket and a refill tube configured for receiving perfume from another container. A towel, such as a micro-fiber towel, may be stored within the top portion of the first built-in pocket and disposable tissues may be stored in the bottom portion of the first built-in pocket.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
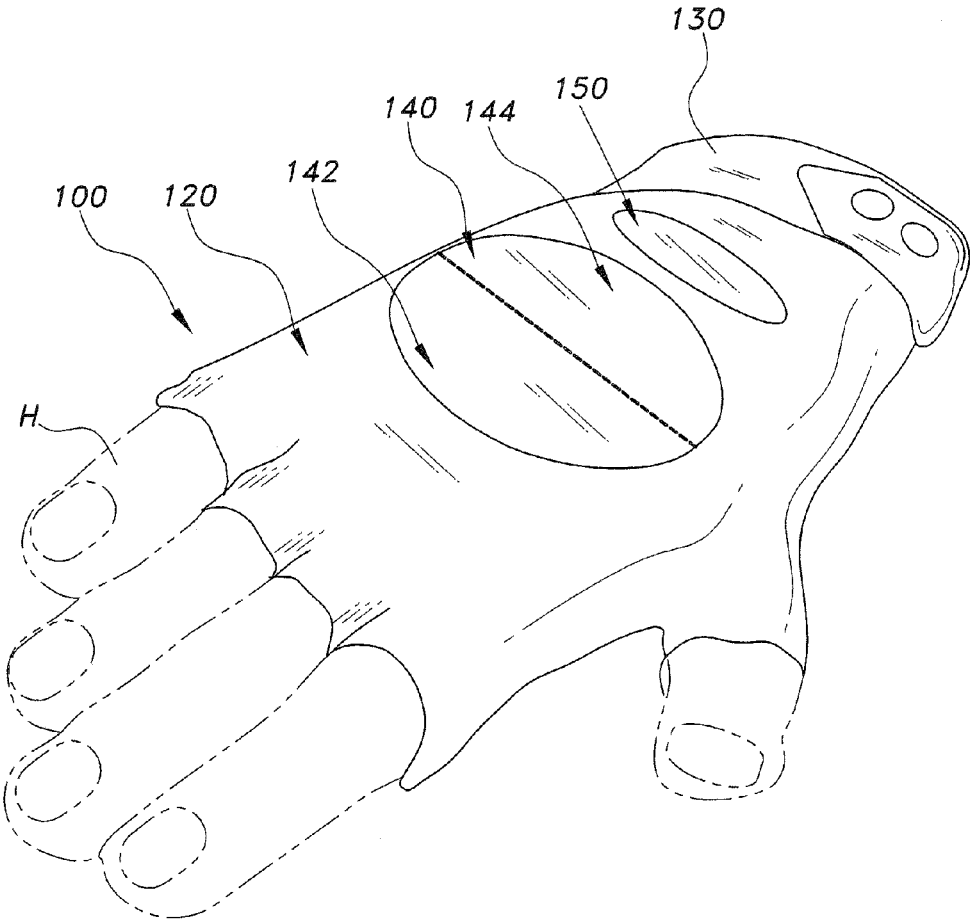
FIG. 1 is an environmental, perspective view of a hygienic sports glove, according to the present invention.
Figure 2:
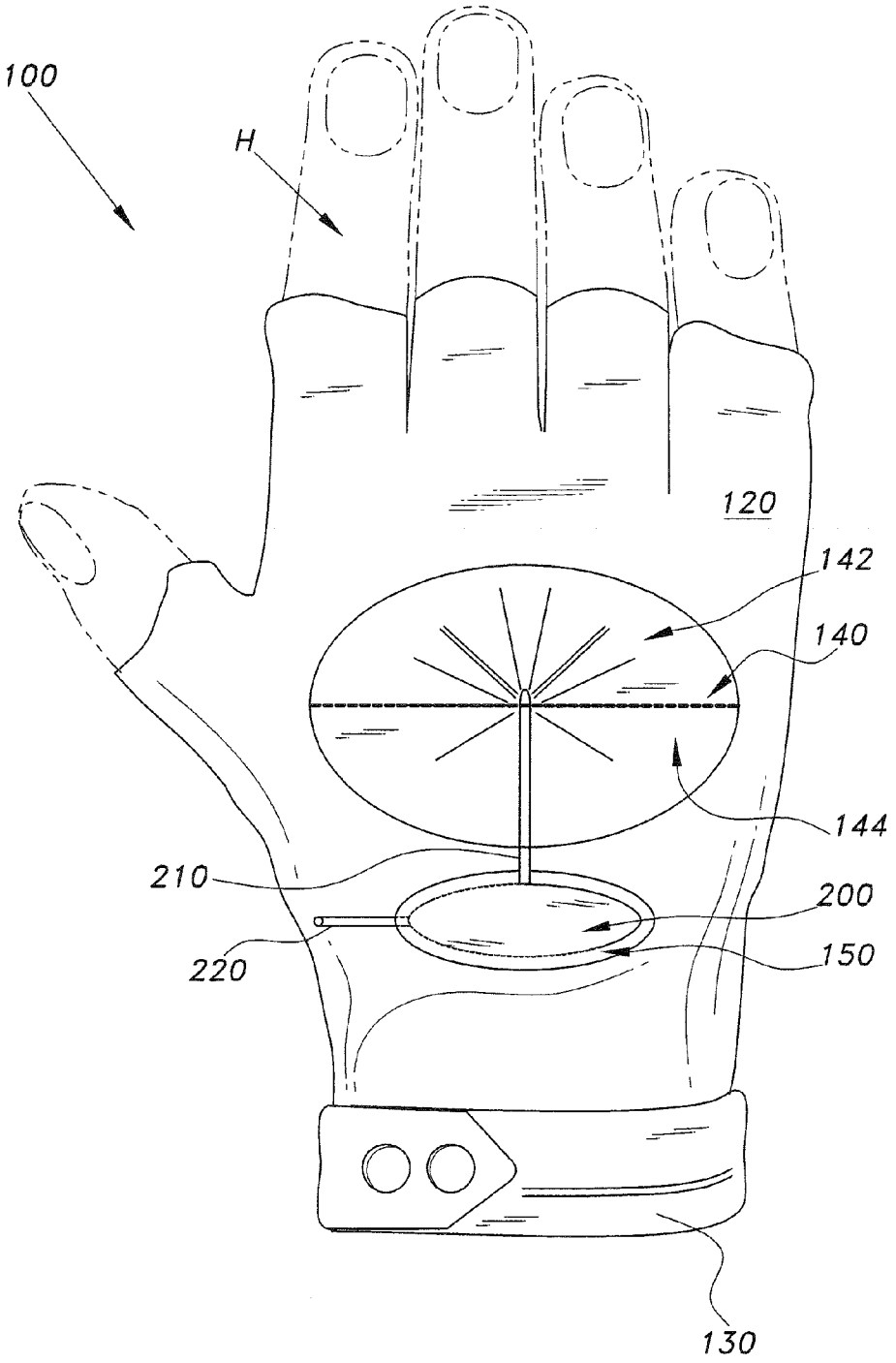
FIG. 2 is a top view of a hygienic sports glove, according to the present invention.
Figure 3:
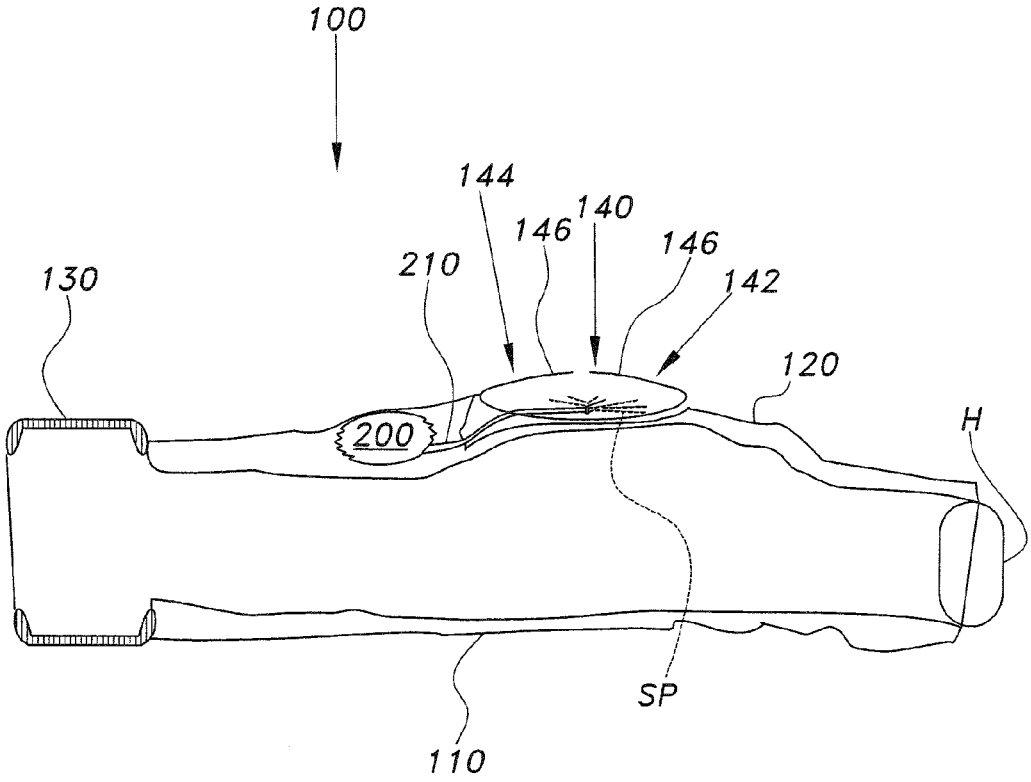
FIG. 3 is a side view of a hygienic sports glove, according to the present invention.
Figure 4:
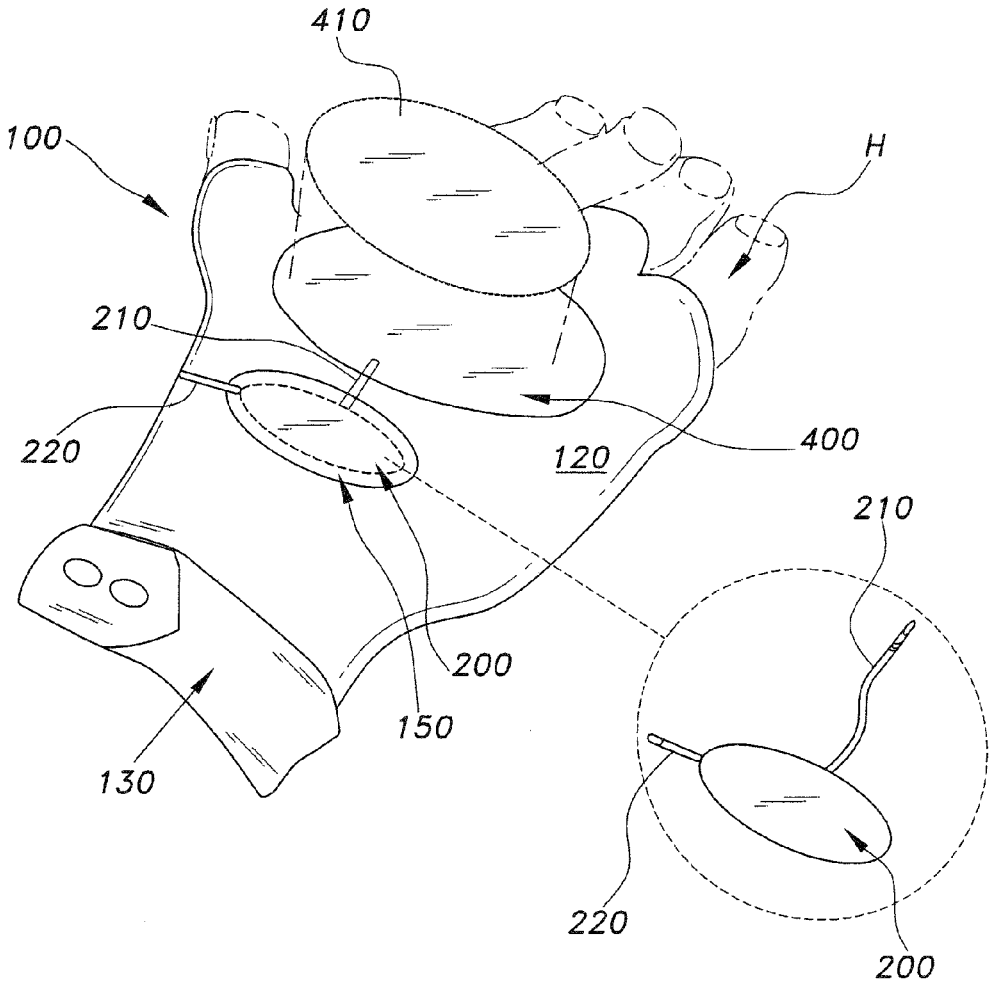
FIG. 4 illustrates a hygienic sports glove having a micro-fiber towel, according to the present invention.

Referring to FIGS. 1 through 6, a hygienic sports glove is generally illustrated. The glove is configured to be worn on a hand H of user prior to exercise. The glove 100 includes finger portions through which the user's fingers may be inserted and a wrist portion with a strap 130. The glove 100 includes a palm surface 110 (FIG. 3) and an opposing back surface 120 extending between the finger portions and the wrist portion. The strap 130 is configured for securing the glove 100 onto the wrist of a user. The glove 100 includes a first built-in pocket 140 positioned on the back surface 120 of the glove 100. The first built-in pocket 140 has a top portion 142 and a bottom portion 144. Each portion 142, 144 has a corresponding flexible flap 146 (FIG. 3). A second built-in pocket 150 is positioned adjacent to the first built-in pocket 140 of the glove 100. A perfume container 200 (FIG. 2), such as a spray-type perfume container, is positioned within the second built-in pocket 150. The perfume container 200 can be a compressible container including a spray nozzle 210 positioned in fluid communication with the first built-in pocket 140 and a refill tube 220 configured for receiving perfume from another container (not shown). The container 200 is configured to release liquid contained therein through the spray nozzle 210 upon compression of the container 200.

The glove 100 can be an open-fingered glove made from any suitable material typically used for gloves. The glove 100 can also be made in a variety of sizes. Further, the strap 130 can be any suitable type of strap with fasteners, e.g., hook-and-loop fasteners, configured to secure the glove 100 onto a user's wrist.

The first built-in pocket 140 is configured for holding a towel 400, such as a microfiber towel and/or a plurality of tissues 410. In other words, the towel 400 and/or the tissues 410 can be disposed in the first built-in pocket 140 of the glove 100. Preferably, the towel 400 is disposed in the top portion 142 of the first built-in pocket 140 and the plurality of tissues 410 are disposed in the bottom portion 144 of the first built-in pocket 140 of the glove 100. As illustrated in FIG. 3, the flaps 146 may be used to secure the towel 400 and/or the plurality of tissues 410 within the first built-in pocket 140. It is to be understood that the plurality tissues 410 can be disposable tissues.

Figure 5:
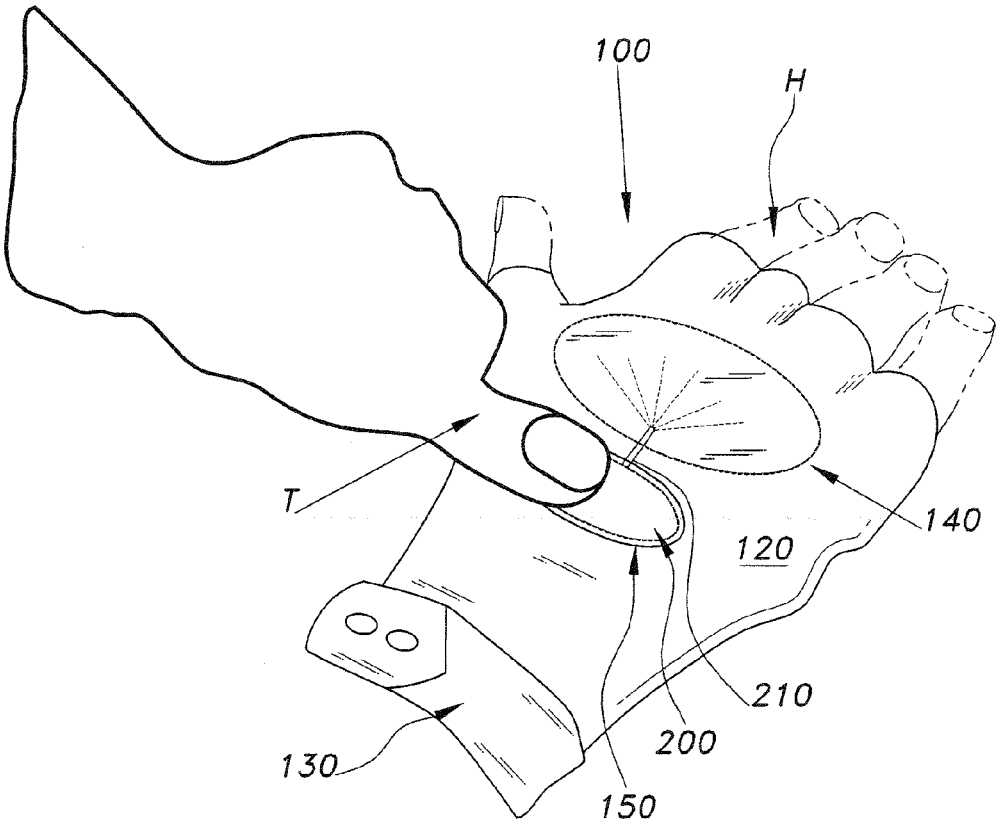
FIG. 5 illustrates a use compressing a perfume container of a hygienic sports glove, according to the present invention.
Figure 6:
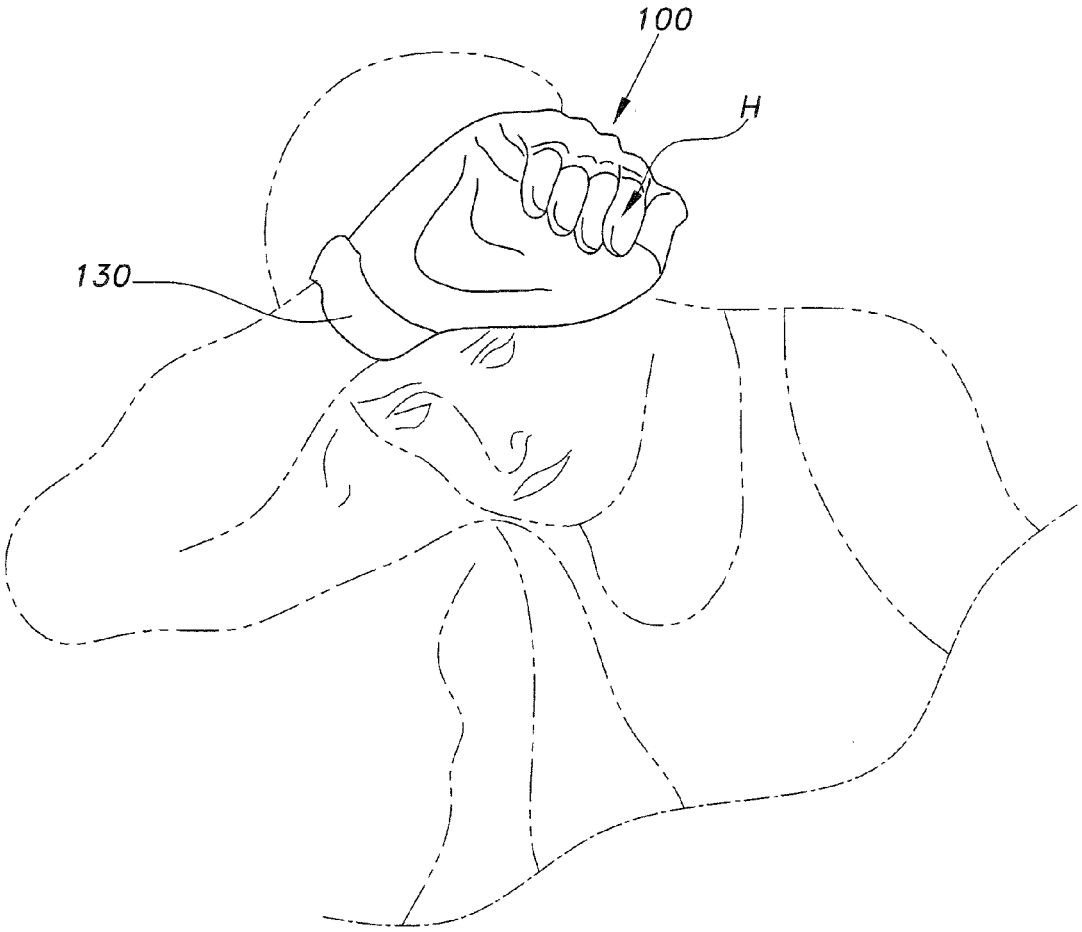
FIG. 6 illustrates a user using the hygienic sports glove to wipe sweat off, according to the present invention.

Referring to FIGS. 5 and 6, by way of operation, a user wears the glove 100 and secures the strap 130 prior to exercising. When the user begins to sweat, the user can use the towel 400, stored within the first built-in pocket 140 or a tissue from the plurality of tissues 410 in the first built-in pocket 140 to wipe the sweat. The towel 400 and each of the plurality of tissues 410 can be used in lieu of a traditional towel. If the users desires that the towel 400 and/or tissues 410 be scented, the user can activate the perfume container 200 by using his or her other hand to compress the container 200 to spray the perfume or cologne onto the towel 400 and/or tissues 410 via the first nozzle 210. Alternatively, as illustrated in FIG. 6, the user can compress the container 200 using his/her forehead while wiping the sweat off of his/her forehead so as to apply perfume or cologne onto the skin.

As illustrated in FIG. 3 once the container 200 is pressed, spray particles SP of the cologne or perfume are dispersed into the first built-in pocket 140 of the glove 100 to perfume the towel 400 and/or the tissues 410. It is to be understood that the container 200 can be configured to prevent any cologne or perfume from draining out of the container 200 accidentally, such as without the person compressing the container 200. Once the container 200 is empty, the refill tube 210 can be used to refill the container 200 with additional perfume or cologne, such as from another container.

It is to be understood that the present invention is not limited to the embodiments described above, but encompasses any and all embodiments within the scope of the following claims.

I claim:

1. A hygienic sports glove, comprising:

a glove having finger portions, a wrist portion, a palm surface and an opposing back surface, the palm surface and the back surface extending between the finger portions and the wrist portion;

a strap at the wrist portion configured for securing the glove onto a user's wrist;

a first built-in pocket positioned on the back surface of the glove, the first built-in pocket having a top portion and a bottom portion;

a second built-in pocket positioned adjacent to the first built-in pocket of the glove; and a perfume container positioned in the second built-in pocket, the container having a spray tube positioned in fluid communication with the first built-in pocket and a refill tube configured for receiving perfume from another container.

2. The hygienic sports glove according to claim 1, wherein each portion includes a corresponding flap.

3. The hygienic sports glove according to claim 1, further comprising a towel stored in the top portion of the first built-in pocket.

4. The hygienic sports glove according to claim 3, wherein the towel is a microfiber towel.

5. The hygienic sports glove according to claim 1, further comprising a plurality of tissues removably disposed in the bottom portion of the first built-in pocket.

6. The hygienic sports glove according to claim 1, wherein the finger portions have openings defined therethrough.

7. The hygienic sports glove according to claim 1, wherein the perfume container comprises a spray container.

8. The hygienic sports glove according to claim 7, wherein the perfume container is compressible.

* * * * *